US006772688B2

(12) United States Patent
Argiros et al.

(10) Patent No.: US 6,772,688 B2
(45) Date of Patent: Aug. 10, 2004

(54) IMAGING SYSTEM WITH AUTOMATED PLATE LOCATING MECHANISM AND METHOD FOR LOADING PRINTING PLATE

(75) Inventors: James M. Argiros, Exeter, NH (US); Jonathan D. Savage, Wilmington, MA (US); Nicholas D'Alleva, Litchfield, NH (US)

(73) Assignee: Agfa Corporation, Wilmington, MA (US)

( * ) Notice: Subject to any disclaimer, the term of this patent is extended or adjusted under 35 U.S.C. 154(b) by 102 days.

(21) Appl. No.: 10/116,947

(22) Filed: Apr. 5, 2002

(65) Prior Publication Data

US 2003/0188655 A1 Oct. 9, 2003

(51) Int. Cl.[7] ..... B65H 9/10; B41F 21/00

(52) U.S. Cl. ..... 101/477; 101/481; 271/240; 271/227

(58) Field of Search ..... 101/477, 401.1, 101/481, 486, DIG. 36; 271/226, 253, 275, 240, 248, 250, 238, 227; 400/579, 630; 33/614, 617, 618, 619, 620, 621; 347/248

(56) References Cited

U.S. PATENT DOCUMENTS 936,108 A * 10/1909 Ford ..... 271/240
2,565,054 A * 8/1951 Watrous ..... 271/236
4,191,106 A 3/1980 Fermi et al. ..... 101/415.1
4,533,239 A * 8/1985 Back ..... 355/72
4,558,615 A 12/1985 Kuehfuss ..... 83/74
4,569,286 A 2/1986 Bleckmann et al. ..... 101/382
4,591,143 A * 5/1986 Jeschke ..... 271/227
4,653,399 A 3/1987 Kuehfuss ..... 101/426
4,743,324 A 5/1988 Boyce et al. ..... 156/215
4,748,911 A 6/1988 Kobler ..... 101/378
4,850,102 A 7/1989 Hironaka et al. ..... 29/787
4,900,008 A 2/1990 Fichter et al. ..... 271/277

(List continued on next page.)

*Primary Examiner*—Leslie J. Evanisko
(74) *Attorney, Agent, or Firm*—Erik L. Ence; Robert A. Sabourin

(57) ABSTRACT

In an external drum imaging system, a plate locating mechanism and method for operation of same are provided for automatically locating printing plates of various sizes in a staging position so as to be mounted on a predetermined position on external drum of the imaging system. The predetermined position in a particular embodiment is substantially center-justified on the external drum to help prevent artifacts in the recorded image.

16 Claims, 8 Drawing Sheets

U.S. PATENT DOCUMENTS

| | | | | |
|---|---|---|---|---|
| 4,936,175 | A | 6/1990 | Clark | 83/167.1 |
| 5,009,509 | A | 4/1991 | Matoushek et al. | 346/138 |
| 5,127,322 | A | 7/1992 | Kobler | 101/219 |
| 5,317,971 | A | 6/1994 | Deye, Jr. et al. | 101/486 |
| 5,331,893 | A | 7/1994 | Wieland | 101/486 |
| 5,377,590 | A | 1/1995 | Bolza-Schünemann et al. | 101/389.1 |
| 5,497,703 | A | 3/1996 | Becker | 101/415.1 |
| 5,564,337 | A | 10/1996 | Uehara et al. | 101/408 |
| 5,584,242 | A | 12/1996 | Fuller et al. | 101/415.1 |
| 5,685,226 | A | 11/1997 | Fuller | 101/415.1 |
| 5,764,268 | A | 6/1998 | Bills | 347/213 |
| 5,806,431 | A | 9/1998 | Muth | 101/486 |
| 5,828,399 | A | 10/1998 | Van Aken et al. | 347/153 |
| 5,913,267 | A | 6/1999 | Britsch | 101/401.1 |
| 6,041,710 | A | 3/2000 | Yasuhara | 101/415 |
| 6,053,105 | A | 4/2000 | Rudzewitz | 101/477 |
| 6,074,112 | A | 6/2000 | Desie et al. | 400/118.3 |
| 6,085,657 | A | 7/2000 | Rombult et al. | 101/471 |
| 6,097,418 | A | 8/2000 | Larsen et al. | 347/235 |
| 6,133,936 | A | 10/2000 | Blake et al. | 347/262 |
| 6,174,095 | B1 | 1/2001 | Desie et al. | 400/118.3 |
| 6,184,520 | B1 | 2/2001 | Manning et al. | 250/234 |
| 6,213,020 | B1 | 4/2001 | Kawada et al. | 101/486 |
| 6,220,589 | B1 | 4/2001 | Smith, III et al. | 269/156 |
| 6,233,038 | B1 | 5/2001 | Lennhoff et al. | 355/47 |
| 6,237,491 | B1 | 5/2001 | Yasuhara et al. | 101/415.1 |
| 6,238,113 | B1 | 5/2001 | Dodge | 400/613 |
| 6,239,882 | B1 | 5/2001 | De Mangelaere et al. | 358/474 |
| 6,250,221 | B1 | 6/2001 | Tice | 101/246 |
| 6,260,482 | B1 | 7/2001 | Halup et al. | 101/477 |
| 6,268,905 | B1 | 7/2001 | Schindler | 355/64 |
| 6,271,871 | B1 | 8/2001 | Rombult et al. | 347/171 |
| 6,295,929 | B1 | 10/2001 | Tice et al. | 101/477 |
| 6,299,045 | B1 | 10/2001 | Hebert et al. | 226/90 |
| 6,318,262 | B1 | 11/2001 | Wolber et al. | 101/401.1 |
| 6,321,651 | B1 | 11/2001 | Tice et al. | 101/248 |
| 6,604,465 | B2 | 8/2003 | Tice et al. | |
| 2003/0056671 | A1 * | 3/2003 | Hashiguchi | 101/477 |
| 2003/0106448 | A1 * | 6/2003 | Uemura | 101/477 |
| 2004/0020388 | A1 * | 2/2004 | Koyanagi et al. | 101/415.1 |

* cited by examiner

IMAGING SYSTEM WITH AUTOMATED PLATE LOCATING MECHANISM AND METHOD FOR LOADING PRINTING PLATE

BACKGROUND OF THE INVENTION

In external drum image recording devices, a movable optical carriage is used to displace an image exposing or recording source in a slow scan direction while a cylindrical drum supporting recording material on an external surface thereof is rotated with respect to the image exposing source. The drum rotation causes the recording material to advance past the exposing source along a direction which is substantially perpendicular to the slow scan direction. The recording material is therefore advanced past the exposing source by the rotating drum in a fast scan direction.

An image exposing source may include an optical system for scanning one or more exposing or recording beams. Each recording beam may be separately modulated according to a digital information signal representing data corresponding to the image to be recorded.

The recording media to be imaged by an external drum imaging system is commonly supplied in discrete sheets and may comprise a plurality of plates, hereinafter collectively referred to as "plates" or "printing plates." Each plate may comprise one or more layers supported by a support substrate, which for many printing plates is a plano-graphic aluminum sheet. Other layers may include one or more image recording (i.e., "imageable") layers such as a photosensitive, radiation sensitive, or thermally sensitive layer, or other chemically or physically alterable layers. Printing plates which are supported by a polyester support are also known and can be used in the present invention. Printing plates are available in a wide variety of sizes, typically ranging, e.g., from 9"×12", or smaller, to 58"×80", or larger. The printing plate may additionally comprise a flexographic printing plate.

SUMMARY OF THE INVENTION

In accordance with embodiments of the recording device or imaging system described herein, it is desirable to center-justify the printing plate on the drum, for example, to reduce vibrations as the drum rotates. Counterweights can be positioned on each end of the drum to compensate for the extra weight of the plate to balance the drum to minimize or eliminate the introduction of vibration-induced artifacts into the images recorded on the plate.

In an external drum imaging system, a plate locating mechanism and method for operation of same are provided for automatically locating printing plates of various sizes in a staging position so as to be mounted on a predetermined position on external drum of the imaging system. The predetermined position in a particular embodiment is substantially center-justified on the external drum to help prevent artifacts in the recorded image.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of various embodiments of the invention follows.

Figure 1:
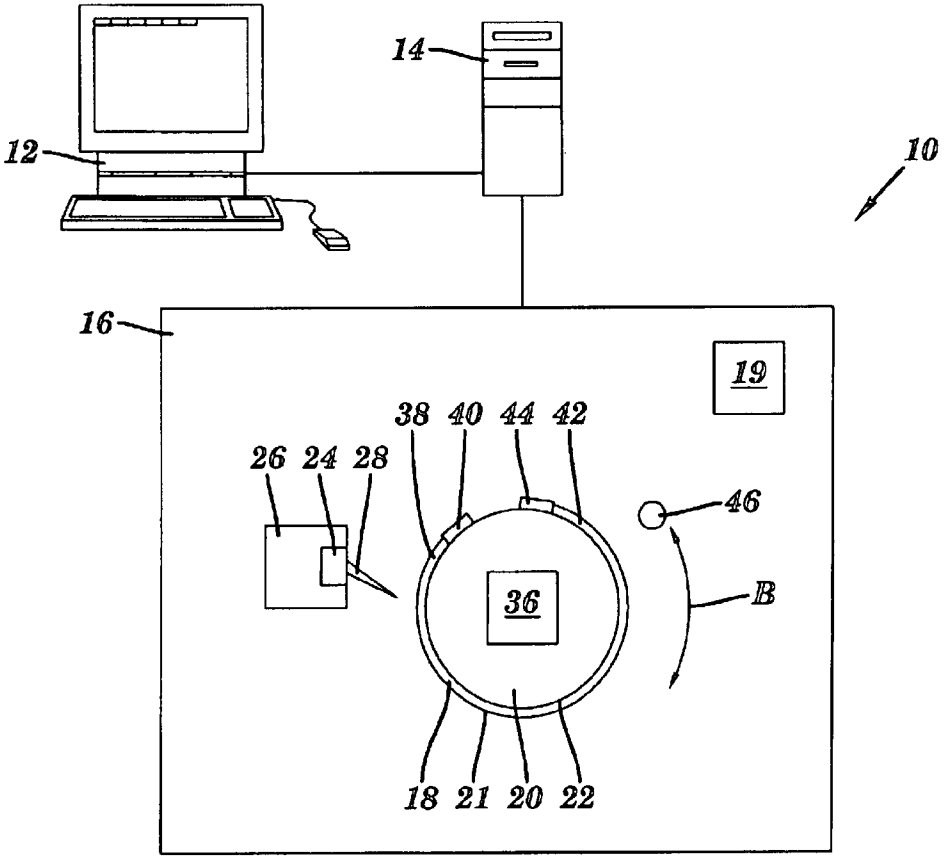
FIG. 1 PRIOR ART
FIG. 1 illustrates an external drum imaging system for recording images onto a supply of recording media such as a printing plate.

Various aspects of the present invention can be used in imaging systems set forth in commonly assigned U.S. Pat. No. 6,295,929, filed May 17, 2000; U.S. Pat. No. 6,318,262, filed May 17, 2000; and U.S. Pat. No. 6,321,651, filed May 15, 2000, the entire teachings of each reference being incorporated herein by reference. As shown in FIG. 1, an imaging system 10 generally includes a front end computer or workstation 12 for the design, layout, editing, and/or processing of digital files representing pages to be printed, a raster image processor (RIP) 14 for further processing the digital pages to provide rasterized page data (e.g., rasterized digital files) for driving an image recorder, and an image recorder, such as an external drum platesetter 16, for recording the rasterized digital files onto a printing plate or other recording media. The external drum platesetter 16 records the digital data (i.e., "job") provided by the RIP 14 onto a photosensitive, radiation sensitive, thermally sensitive, or other type of suitable printing plate 18. The printing plate 18 can be manually loaded onto a staging area of the external drum platesetter 16 by an operator. Alternately, or in addition to manual loading, the printing plate may be provided and loaded onto the external drum platesetter 16 by a media supply or autoloading system 19. The media supply system 19 may accept a plurality of the same size printing plates 18, and/or may accept a plurality of different size printing plates 18.

The external drum platesetter 16 includes an external drum 20 having a cylindrical media support surface 22 for supporting the printing plate 18 during imaging. The external drum platesetter 16 further includes a scanning system 24, coupled to a movable carriage 26, for recording digital data onto the imaging surface 21 of the printing plate 18 using a single or multiple imaging beams 28.

The external drum 20 is rotated by a drive system 36 in a clockwise or counterclockwise direction as indicated by directional arrow B in FIG. 1. Typically, the drive system 36 rotates the external drum 20 at a rate of about 100–1000 rpm. In one embodiment, the printing plate 18 is loaded onto the external drum 20 while rotating the drum in a first direction. The printing plate 18 is then imaged while the drum is rotated in the first, or in a second, opposite direction. The printing plate 18 is then unloaded from the external drum 20 while rotating the drum in the second direction.

The leading edge 38 of the printing plate 18 is held in position against the media support surface 22 by a leading edge clamping mechanism 40. Similarly, the trailing edge 42 of the printing plate 18 is held in position against the media support surface 22 by a trailing edge clamping mechanism 44. Both the trailing edge clamping mechanism 44 and the leading edge clamping mechanism 40 provide a tangential friction force between the printing plate 18 and the external drum 20 sufficient to resist the tendency of the edges of the printing plate 18 to pull out of the clamping mechanisms 40, 44, at a high drum rotational speed. In accordance with one embodiment of the present invention, only a small section (e.g., 6 mm) of the leading and trailing edges 38, 42, is held against the external drum 20 by the leading and trailing edge clamping mechanisms 40, 44, thereby increasing the available imaging area of the printing plate 18.

A stationary ironing roller system 46 flattens the printing plate 18 against the media support surface 22 of the external drum 20 as the external drum 20 rotates past the ironing roller 46 during the loading of the printing plate 18. Alternately, or in addition, a vacuum source may be used to draw a vacuum through an arrangement of ports and vacuum grooves formed in the media support surface 22 to hold the printing plate 18 against the media support surface 22. A registration system, comprising, for example, a set of registration pins or stops on the external drum 20, and a plate edge detection system, may be used to accurately and repeatably position and locate the printing plate 18 on the external drum 20. The plate edge detection system, as described infra, may comprise, for example, a plurality of sensors and/or the scanning system 24.

Figure 2:
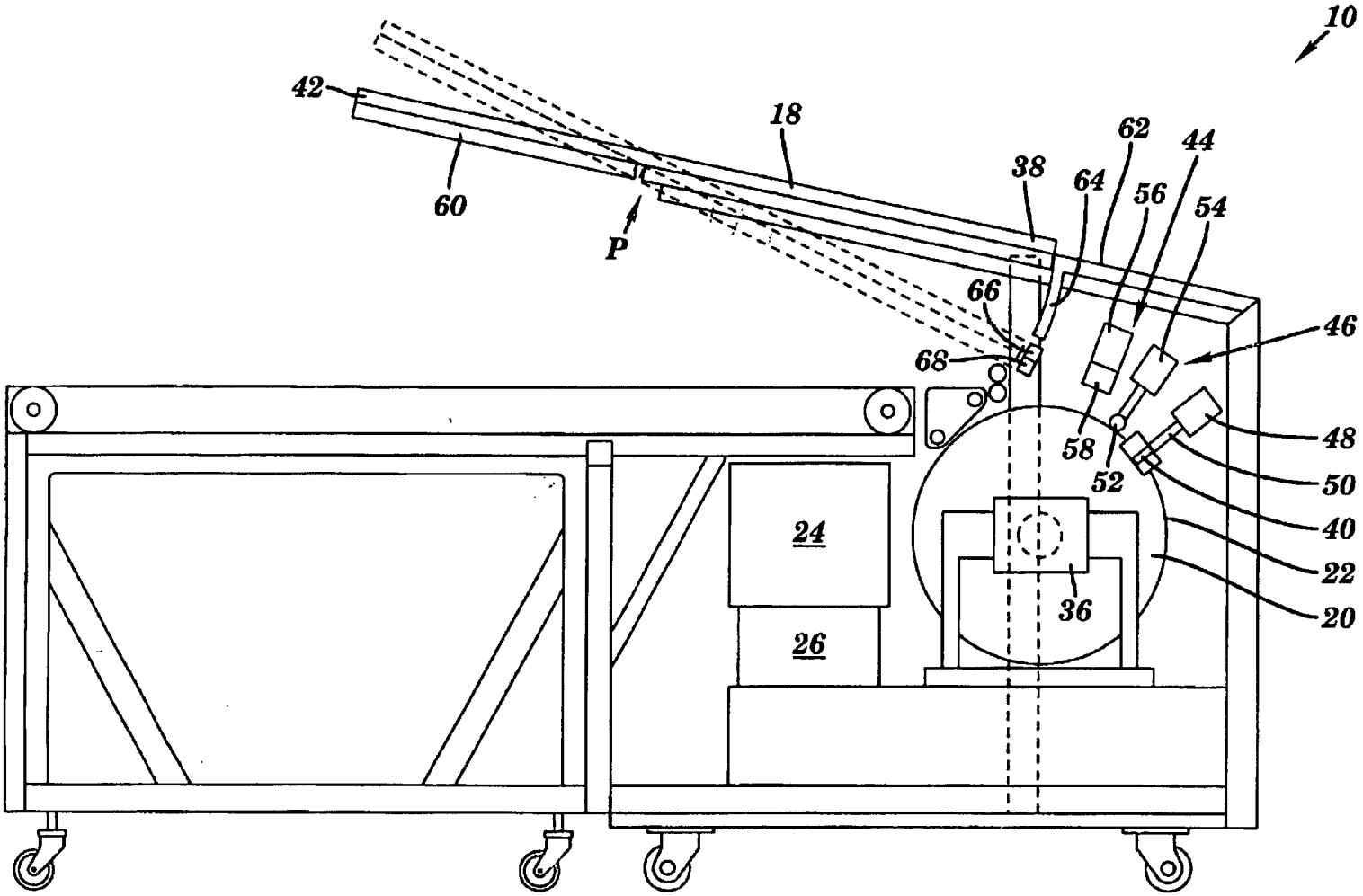
FIG. 2 illustrates the media handling system of an external drum imaging system used in accordance with the present invention.

In a particular embodiment of an imaging system 10 shown in FIG. 2, the leading edge clamping mechanism 40 is actuated by an actuator 48 via an extendable member 50 to selectively receive, capture, and release the leading edge 38 of the printing plate 18. The stationary ironing roller system 46 is used to selectively force the printing plate 18 against the media support surface 22 of the external drum 20 as the external drum 20 rotates past the ironing roller system 46 during the loading of the printing plate 18. The stationary ironing roller system 46 includes an ironing roller assembly 52, including one or more rollers, and an actuating system 54 for selectively extending or retracting the ironing roller assembly 52 toward or away from the external drum 20. The ironing roller assembly 52 is retracted away from the external drum 20 prior to the imaging of the printing plate 18.

The trailing edge clamping mechanism 44 includes an actuator 56 used to employ one or more magnetic clamps 58 to securely clamp the trailing edge 42 of the printing plate 18 to the drum 20.

The input tray 60 is pivotable about a pivot point P between a landing position (shown in solid lines), where the input tray 60 is aligned with a landing zone 62 (e.g., coplanar with, or parallel to, the landing zone 62), and a loading position (shown in phantom), where the input tray 60 and the printing plate 18 are angled more steeply down toward the external drum 20. The input tray 60 may be manually or automatically pivoted between the landing and loading positions. Either position can be referred to as a staging position. In this embodiment, a guard 64 prevents the printing plate 18 from sliding off the input tray 60 as the input tray 60 is pivoted between the landing and loading positions.

When the input tray 60 is in the loading position, the weight of the printing plate 18 may cause the printing plate 18 to slide downward toward the external drum 20 (i.e., the printing plate 18 is fed by gravity toward the external drum 20). A door 66, or similar escapement mechanism, which is selectively activated (e.g., extended or retracted) by an actuator 68 (e.g., a pneumatic actuator, solenoid, etc.), may be provided to regulate the displacement of the printing plate 18. Alternately, the printing plate 18 may be allowed to slide toward the external drum 20 as soon as the leading edge 38 of the printing plate 18 clears the guard 64.

In alternative embodiments, a printing plate locating mechanism is provided to physically move the printing plate 18 on the input try 60 such that it is fed onto the drum 20 on a predetermined or desired position. The printing plate 18 can be, for example, manually placed on the input tray 60 or deposited thereon by an autoloading system 19. The locating mechanism then automatically moves the printing plate 18, which can be of varying size, to a desired position on the input tray 60, so that it is fed onto the drum 20 at a predetermined position, for example, so as to be substantially center-justified on the drum 20. Center justification has been found to be the most suitable position to prevent vibrations and thus error into the scanned image. Movable counterweights on each end of the drum 20 can be used to compensate for the extra weight of the printing plate 18.

Figure 3:
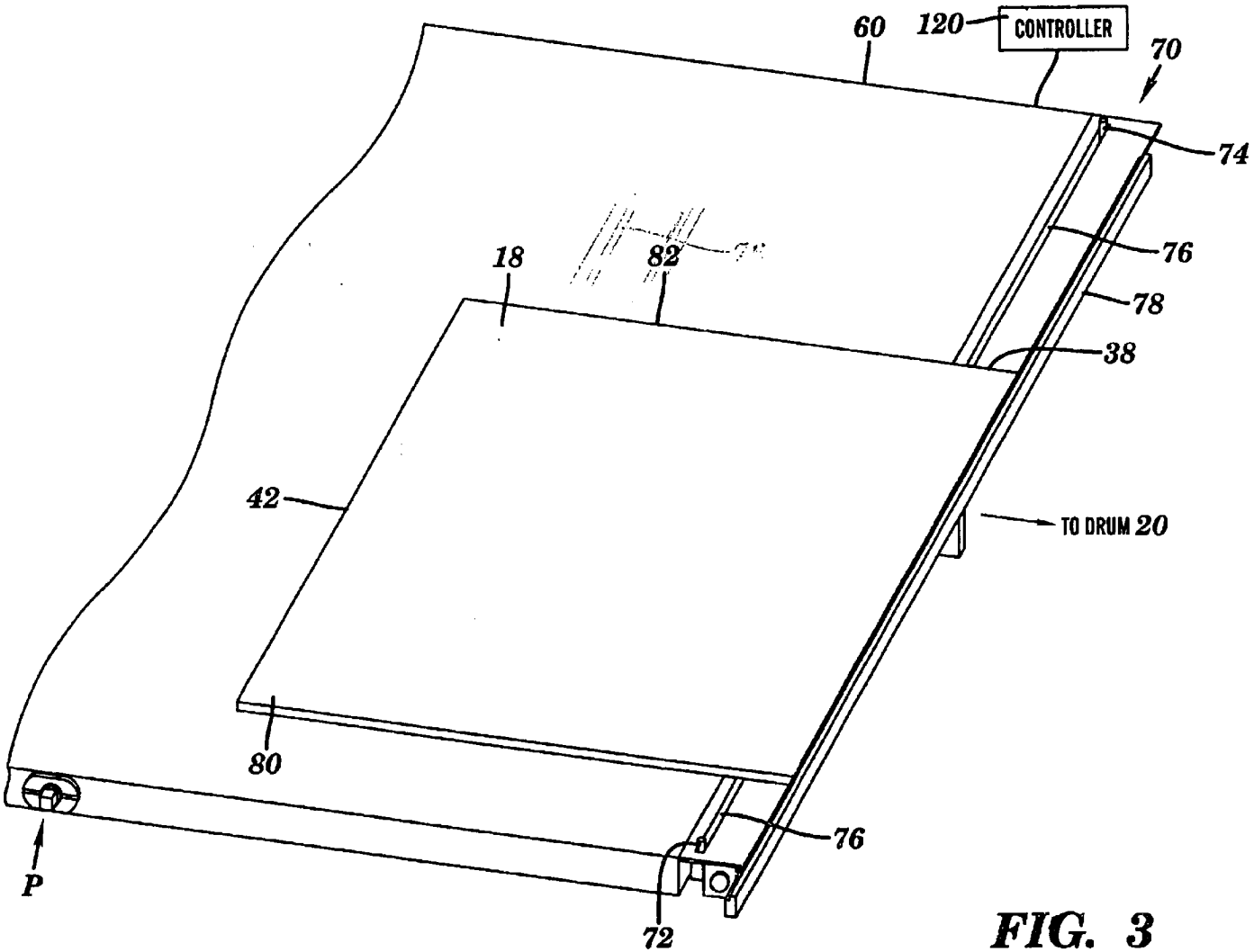
FIG. 3 is a perspective view of an input tray having an automated plate locating mechanism attached thereto used in accordance with one embodiment of the present invention.
Figure 4:
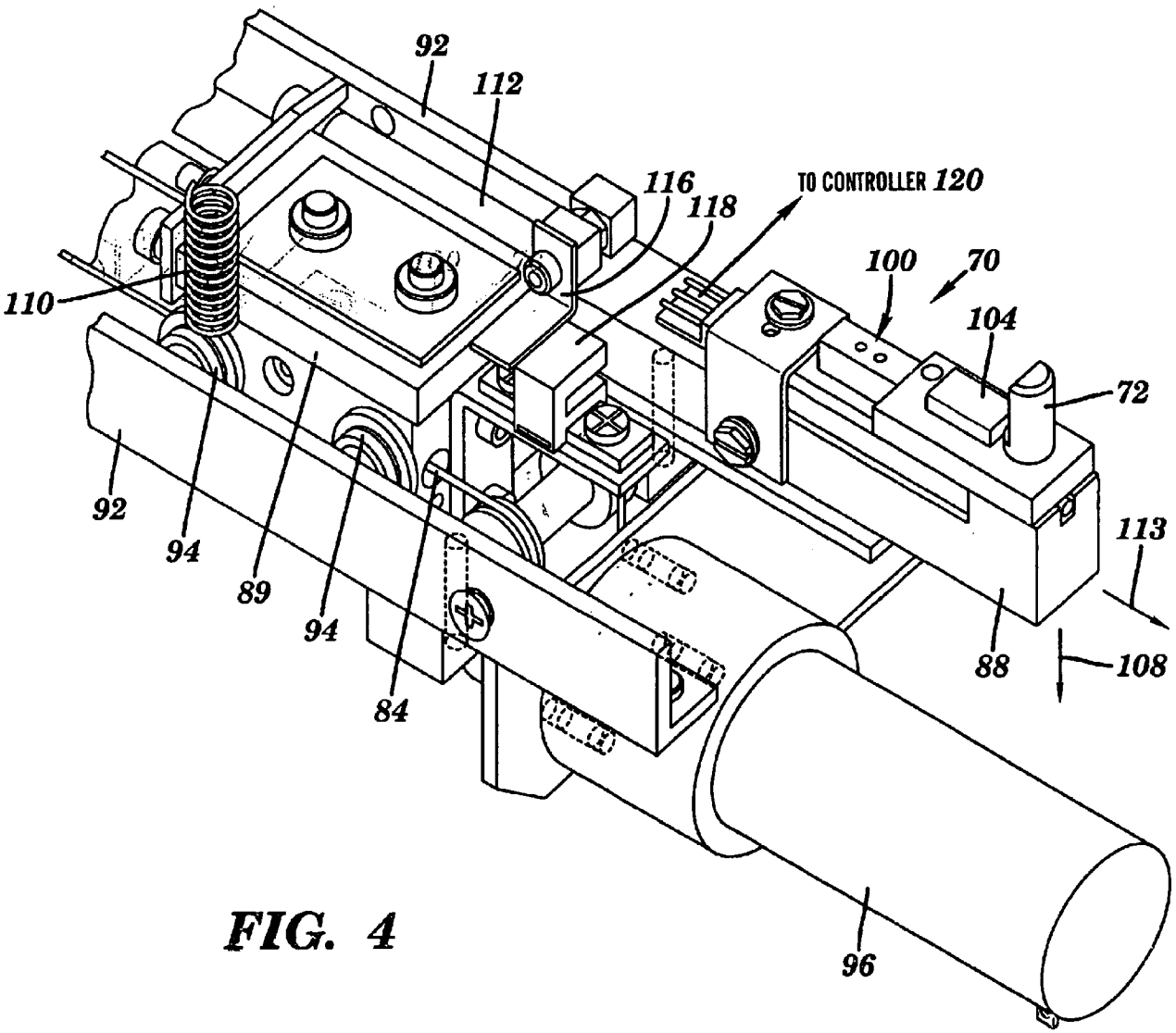
FIGS. 4–6 are perspective views of a first end of a plate locating mechanism used in accordance with an embodiment of the invention.

In one embodiment as shown in FIG. 3, the plate locating mechanism 70 is disposed on the end of the input tray 60 although it could be disposed elsewhere on the imaging system 10. In this particular embodiment, the plate locating mechanism 70 includes a first pin 72 and a second pin 74 which travel along one or more slots 76. In alternative embodiments, a single pin can be used.

After the printing plate 18 is placed on the input tray 60, the leading edge 38 rests on an escapement bar 78 and held thereagainst by gravity. At least one pin 72, 74 is used to locate the printing plate 18 at a desired position on the tray 60 such that when the escapement bar 78 drops, the plate is then center-justified on the drum 20. In this particular embodiment, the desired position on the tray 18 corresponds to the center of input tray 60.

At least one pin, for example, pin 72 contacts the plate 18 along a first edge 80 and drives it until the plate 18 is in the desired position. In one embodiment, the pin 72 drives the plate 18 until the second edge 82 contacts the second pin 74, which is moving in the opposite direction of pin 72. In one embodiment, one of the pins is coupled to a pressure sensor or limit switch to stop the movement of the pins 72, 74 when the plate 18 is in the predetermined position. The escapement bar 78 drops, i.e., rotates, and the plate 18 is mounted onto the drum 20 at the desired location.

In a particular embodiment of the present invention, one of the pins 72, 74 drives the plate 18 on one edge at least until the opposite edge is sensed by a sensing device. Thus, only one edge is contacted to reduce the chance of pinching the plate between the pins 72, 74.

Figure 7:
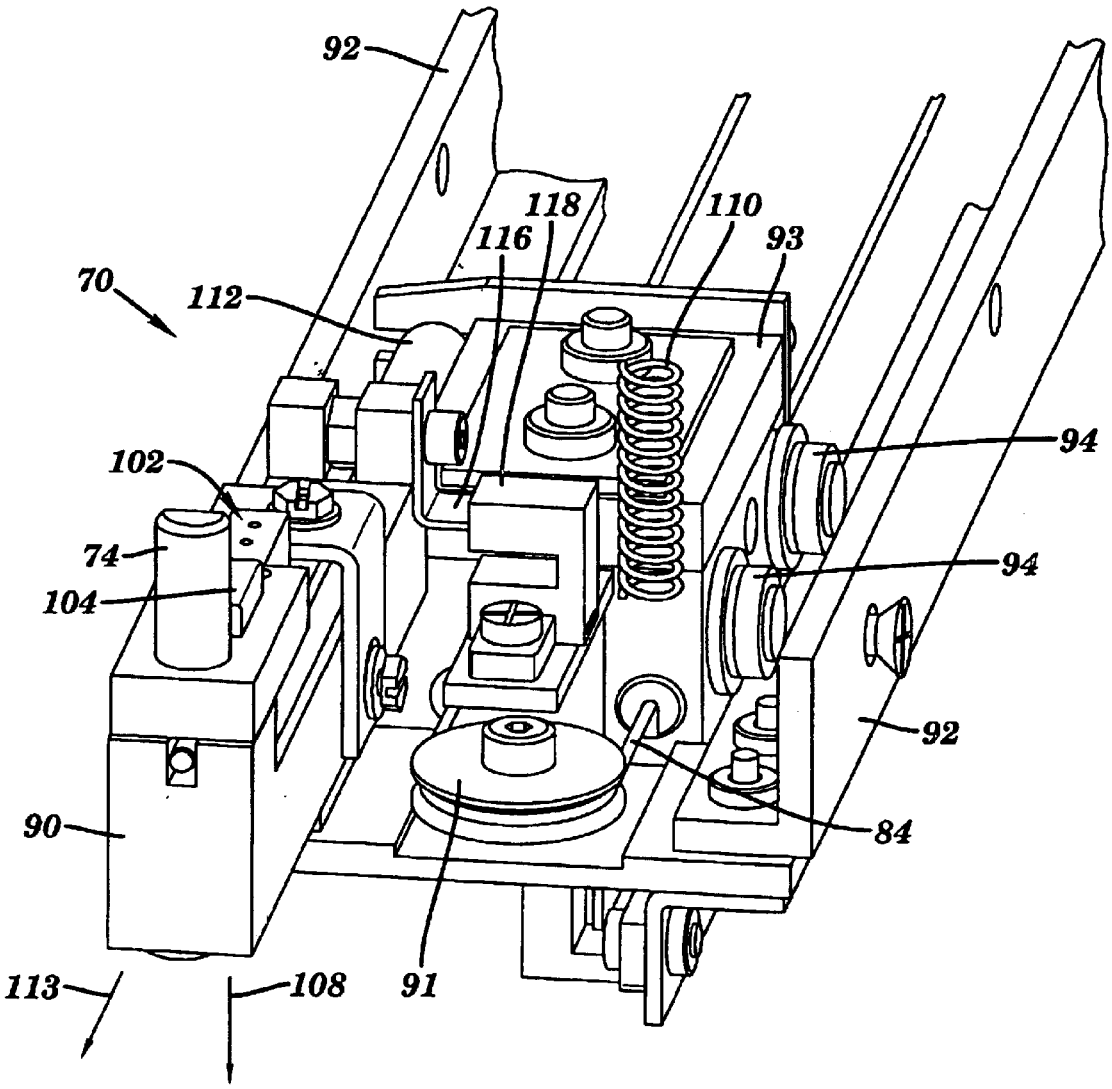
FIG. 7 is a perspective view of a second end of the plate locating mechanism shown in FIGS. 4–6.

In one embodiment of a plate locating mechanism as shown in FIGS. 3–7, pin 72 is mounted on a first assembly 88 (FIGS. 4–6) and pin 74 is mounted on a second assembly 90 (FIG. 7). The assemblies 88, 90 are mounted on rails 92 by wheels 94 mounted on carriages 89, 93 which support the assemblies 88, 90 and which are connected to each other by a cabling system 84. In alternative embodiments, a lead screw can be used to move pins 72, 74. A motor 96, which can include a gear motor, stepper motor, or the like, drives a pulley 98 (best seen in FIG. 6) to move the cable 84 coupled to idler pulley 91 on carriage 93 such that the carriages 89, 93 and thus pins 72, 74 move toward or away from each other.

More particularly, each carriage 89, 93 is fixed on the cable 84 on a different side of a cable loop such that if the motor 96 rotates pulley 98 in a first direction, carriage 89 and thus first pin 72 are moved toward the center of the input tray 60 while carriage 93 and thus pin 74 are also moved toward the center of the input tray 60. If the pulley 98 is rotated in a second direction, pins 72, 74 are moved away from the center of the input tray 60.

A first sensing device 100 is disposed adjacent to the first pin 72 to sense, through slot 76, when a printing plate 18 is adjacent to the pin. In one embodiment, a reflective sensor is used, although any type of sensing device such as proximity sensors, horseshoe-shaped sensors, photo interceptors can be used. A second sensing device 102 is similarly disposed adjacent to pin 74. In this embodiment, sensing devices 100, 102 are located about 0.6" from respective pins 72, 74. A guide 104 is provided on assemblies 88, 90 to guide the assemblies in slots 76. In a particular embodiment, the guide is formed from Delrin® acetal resin, which is sold by E. I. DuPont de Nemours and Company, but it can be formed from almost any material including plastic, wood, or composite material.

Figure 5:
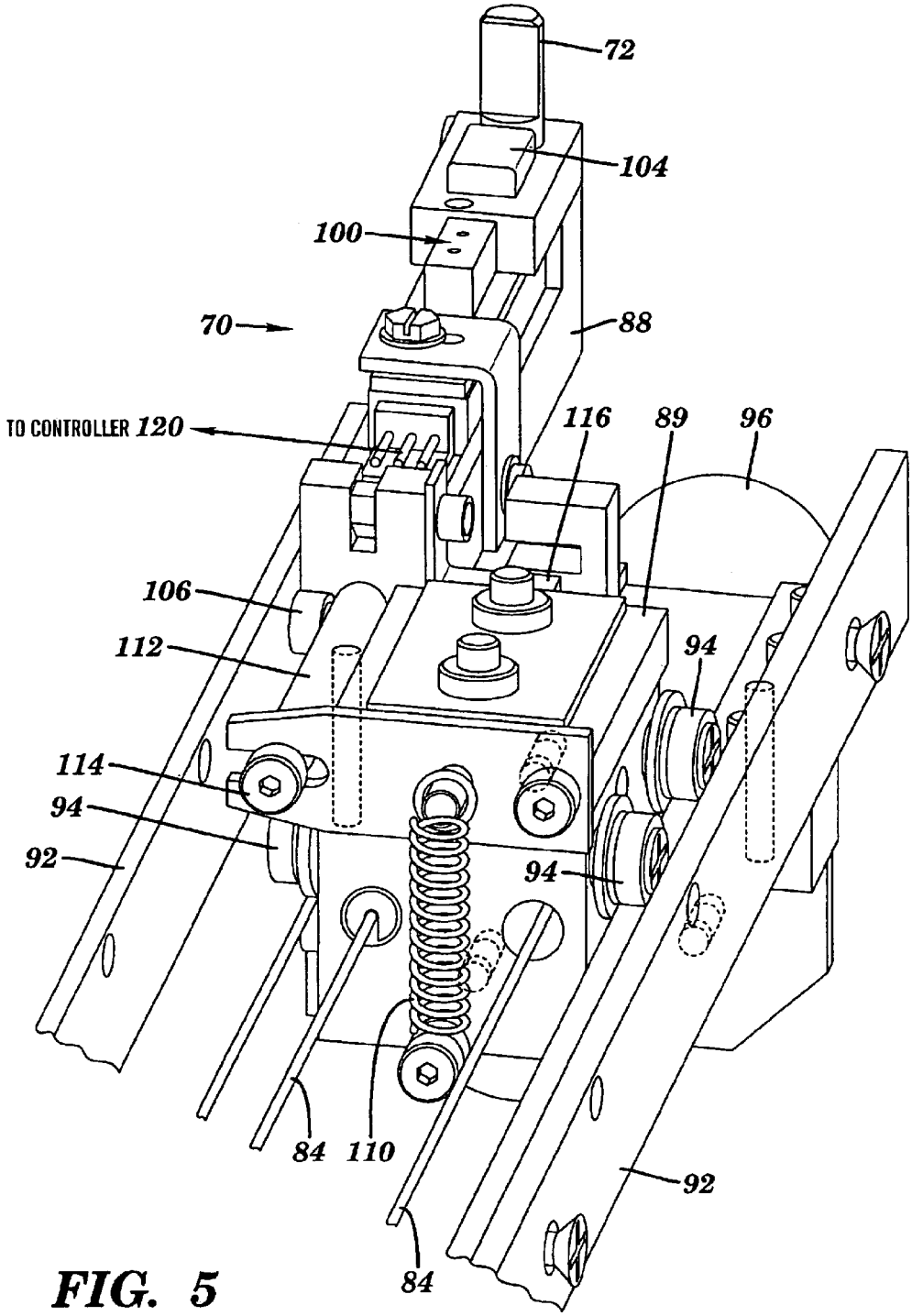
Figure 6:
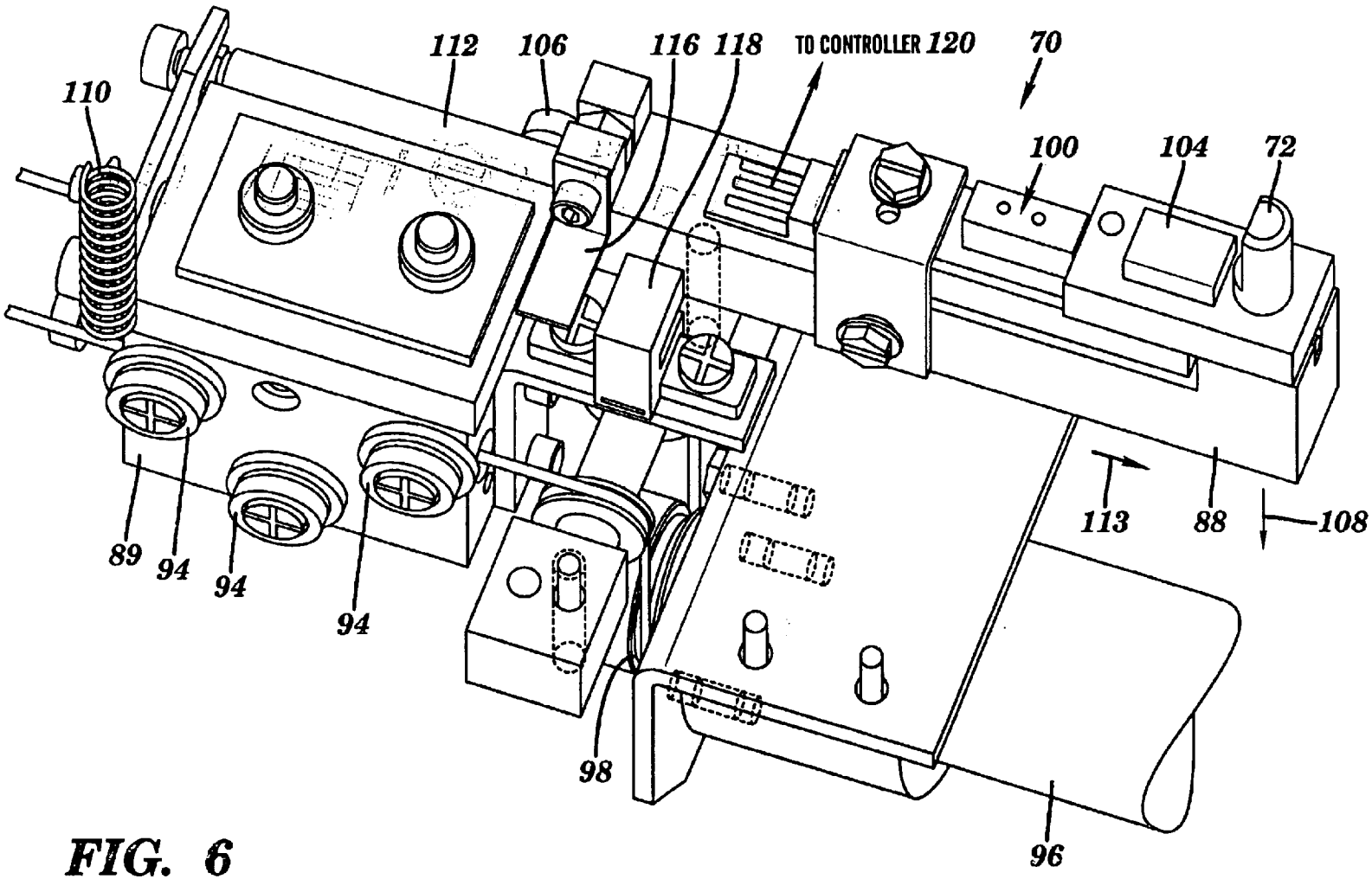

Each pin 72, 74 is designed so that it is biased above the support surface of the input tray 60, but can extend below or even with the support surface, for example, if a printing plate 18 falls on top of pins 72, 74. In this embodiment, each assembly 88, 90 pivots about pin 106 so that pins 72, 74 are able to go below the support surface, i.e., in the direction of arrow 108. As best shown in FIG. 5, a biasing mechanism 110, such as a spring, pulls down on shaft 112 such that assemblies 88, 90 are biased upwards. Thus, damage to the printing plate 18 and locating mechanism 70 is avoided.

One or more pins 72, 74 of the locating mechanism 70 can also be biased in a direction parallel to the slot 76, i.e., parallel to a longitudinal axis of the drum 20. In this embodiment, the pins 72, 74 are biased in a direction toward the center of the input tray 60. Thus, the assemblies 88, 90 can move away from the input tray 60 center relative to respective carriages 89, 93 in the direction of arrow 113 to prevent the pins 72, 74 from damaging the plate 18. In this embodiment, a spring within hollow shaft 112 is coupled to end 114 and to assembly 88 so that assembly 88 is biased toward the center of the input tray 60 but can move away therefrom relative to carriage 89 if necessary. A similar biasing mechanism is provided for pin 74.

If the pins 72, 74 are moved too far on shaft 112 in direction 113, a flag 116 is designed to pass between a sensing device 118 which triggers the controller 120 to stop motor 96 so as to not damage the printing plate 18 or locating mechanism 70. Any similar type of mechanism can be used to signal when assembly 88, 90 has traveled too far on shaft 112 relative to the carriage 89, 93.

In alternative embodiments, assembly 88 is positioned within a "C" shaped rail such that only one rail is needed and a carriage is not needed.

Thus, a printing plate 18 is loaded, manually or automatically onto the input tray 60, such as shown in FIG. 3. Controller 120, which can be used to control the imaging system 10, causes the pins 72, 74 to move toward the center of the tray 60. First sensing device 100 senses the first edge 80. The pins 72, 74 are continued to be driven further such that pin 72 physically moves plate 18 toward the center of the tray 60 until the second sensing device 102 senses the second edge 82 of the plate 18. At that point, the position of the plate 18 on the input tray 60 is known, and thus the position relative to the drum 20 so the plate 18 can be loaded therein at a predetermined location.

In one embodiment, the plate 18 is driven slightly past the second sensing device 102, but is not required. The pins 72, 74 are then retracted, i.e., moved away from the center of the tray 60.

If the plates 18 are always loaded onto the left side of the tray 60 as shown in FIG. 3, the first sensing mechanism 100 and second pin 74 are not required. Similarly, if the plates 18 are always loaded on the right side, second sensing device 102 and first 72 would not be needed. If it is not known onto which side of the tray 60 the plates 18 are loaded, the embodiment shown herein can be used for full automation.

Figure 8:
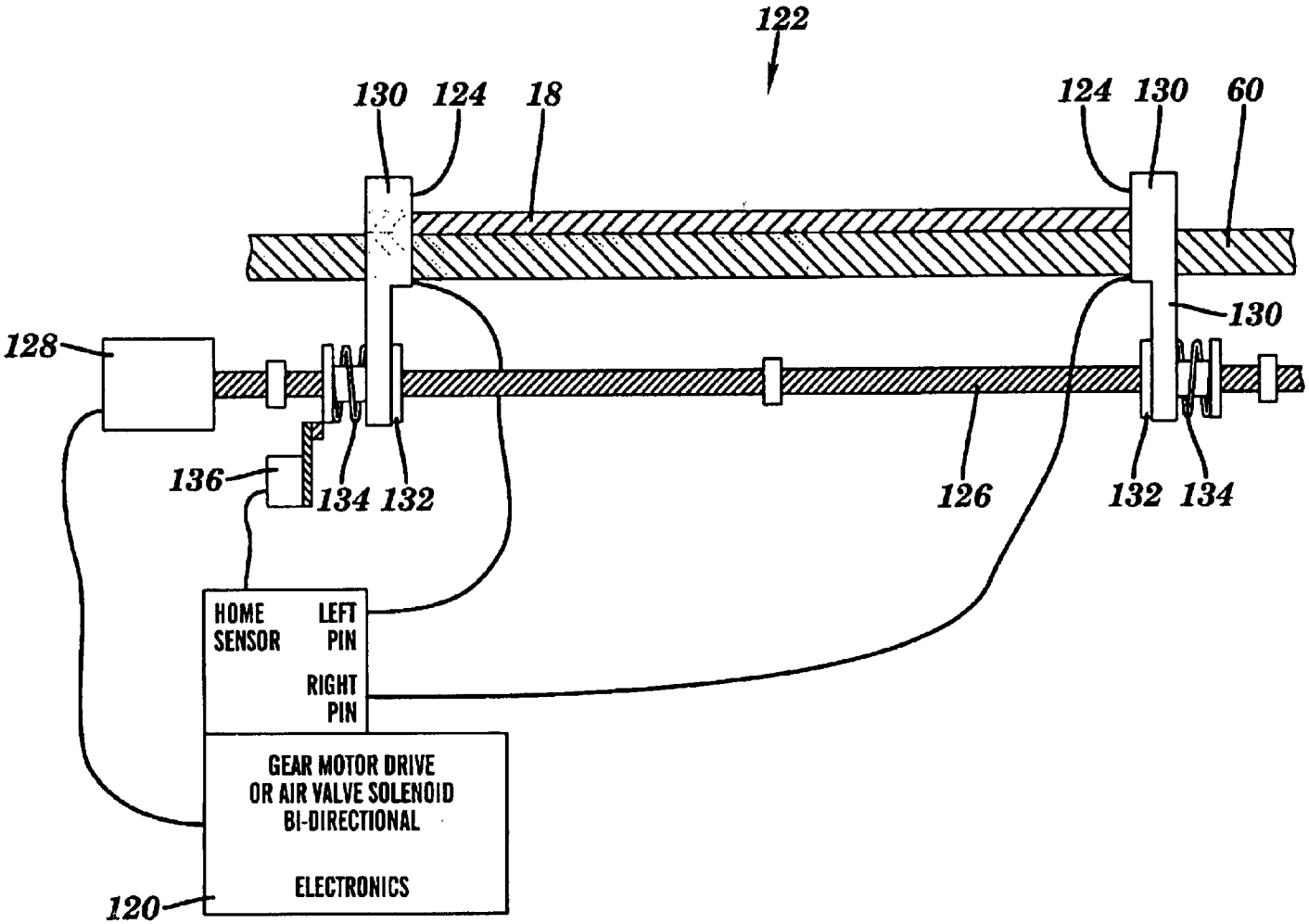
FIG. 8 is a schematic illustrating another plate locating mechanism in accordance with another embodiment of the present invention.

In alternative embodiments, as shown in FIG. 8, a plate locating device 122 is used to locate the printing plate 18 on the tray 60. In this embodiment, the plate 18 acts as a conductor between contacts 124 which are driven in slots 76 by a two-pitch lead screw 126 via motor 128. The mounting members 130 are coupled to a screw nut drive 132 which biases, with springs 134, the members 130 toward the center of the input tray 60. A home switch 136 can be used to determine when the left screw nut drive 132 is in the home position. In alternative embodiments, each contact 124 includes a set of contacts which are connected by the plate 18 when it is adjacent thereto. For this embodiment to work properly, the plate 18 is formed from a conductive material such as aluminum.

While this invention has been particularly shown and described with references to preferred embodiments thereof, it will be understood by those skilled in the art that various changes in form and details may be made therein without departing from the scope of the invention encompassed by the appended claims.

What is claimed is:

1. An external drum imaging system for making printing plates, comprising:

an external drum having a cylindrical media support surface for supporting a printing plate during imaging;

an input tray for supporting the printing plate in a staging position prior to mounting the printing plate onto the cylindrical media support surface of the external drum;

a plate locating mechanism for automatically locating printing plates of various sizes on the input tray in the staging position, the plate locating mechanism comprising (1) a first pin for contacting the printing plate on a first edge, and for moving and aligning the printing plate on the input tray so as to be mounted to a predetermined position on the media support surface of the external drum, and (2) a first sensing device disposed adjacent to the first pin to sense when the first edge of the printing plate is proximate to the first sensing device; and a loading mechanism for loading the printing plate from the input tray to the media support surface of the external drum.

2. The system claim 1, wherein the predetermined position is substantially center-justified on the external drum.

3. The system of claim 1, further comprising a second sensing device to sense when a second edge of the printing plate is proximate to the second sensing device.

4. The system of claim 3, wherein the second sensing device is disposed adjacent to a second pin.

5. The system of claim 4, wherein the first and second pins are movable to a position below or even with a support surface of the input tray.

6. The system of claim 5, wherein the first and second pins are biased above the support surface of the input tray.

7. The system of claim 6, wherein the first and second pins are biased in a direction substantially parallel to a longitudinal axis of the external drum.

8. The system of claim 7, wherein the direction is toward a line perpendicular to the longitudinal axis of the external drum, the line also being positioned equidistantly from first end and a second end of the external drum.

9. The system of claim 1, further comprising a controller for determining when the locating mechanism has located a printing plate at the predetermined position.

10. An external drum imaging system for making printing plates, comprising:

an external drum having a cylindrical media support surface for supporting a printing plate during imaging;

an input tray for supporting the printing plate in a staging position prior to mounting the printing plate onto the media support surface of the external drum;

an automated plate locating mechanism which can automatically locate printing plates of various sizes on the input tray, the locating mechanism comprising a pin that pushes the printing plate on a first edge at least until a sensing device senses a second edge of the printing plate to locate the printing plate to a predetermined position on the input tray relative to the external drum;

a loading mechanism for loading the printing plate from the input tray to the media support surface of the external drum;

a leading edge clamping mechanism and a trailing edge clamping mechanism for holding a leading edge and a trailing edge of the printing plate onto the cylindrical media support surface during rotation of the external drum; and an ironing roller system for pressing the printing plate against the cylindrical media support surface as the external drum rotates past the ironing roller system.

11. The system of claim 10, wherein the predetermined position on the input tray is such that the printing plate is center-justified relative to the external drum.

12. A method for loading a printing plate onto an external drum of an imaging system, comprising:

loading a printing plate onto an input tray of the imaging system;

automatically locating, with a pushing mechanism, the printing plate on the input tray such that the printing plate is located at a predetermined position relative to the external drum, wherein the pushing mechanism pushes the printing plate on a first edge at least until a second edge of the printing plate is sensed by a sensing device; and mounting the printing plate from the input tray onto the external drum.

13. The method of claim 12, wherein the predetermined position is center-justified on the external drum.

14. The method of claim 12, wherein the pushing mechanism pushes the printing plate a predetermined distance past the sensing device.

15. The method of claim 14, further comprising retracting the pushing mechanism.

16. The method of claim 12, wherein the predetermined position is determined by a controller.

* * * * *